US007669549B2

(12) United States Patent
Ueberschär et al.

(10) Patent No.: US 7,669,549 B2
(45) Date of Patent: Mar. 2, 2010

(54) MACHINE FOR SINGLE SIDED OR DOUBLE SIDED APPLICATION OF A LIQUID OR VISCOUS COATING MEDIUM ONTO THE SURFACE OF A MOVING MATERIAL WEB, AND ASSOCIATED OPERATING METHOD

(75) Inventors: Manfred Ueberschär, Gerstetten (DE); Benjamin Méndez-Gallon, Königsbronn (DE); Bernd Bohnenkamp, Menasha, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 837 days.

(21) Appl. No.: 11/015,310

(22) Filed: Dec. 17, 2004

(65) Prior Publication Data

US 2005/0132956 A1 Jun. 23, 2005

(30) Foreign Application Priority Data

Dec. 18, 2003 (DE) ..... 103 59 676

(51) Int. Cl.
*B05B 13/02* (2006.01)

(52) U.S. Cl. ..... 118/325; 118/419; 118/411; 118/262

(58) Field of Classification Search ..... 118/325, 118/DIG. 4, 256, 410, 419, 261–262, 244, 118/602, 429, DIG. 2; 427/420
See application file for complete search history.

(56) References Cited

U.S. PATENT DOCUMENTS 4,841,862 A 6/1989 Seefried ..... 101/425
4,851,268 A * 7/1989 Kozak ..... 427/420
4,879,968 A * 11/1989 Denz et al. ..... 118/300
5,017,408 A 5/1991 Kozak ..... 427/420
5,105,758 A 4/1992 Kozak ..... 118/300
5,733,376 A 3/1998 Costello (Continued)

FOREIGN PATENT DOCUMENTS

DE 195 00 402 7/1996

(Continued)

OTHER PUBLICATIONS

Office Action dated Jul. 13, 2009 in U.S. Appl. No. 11/931,262.

(Continued)

*Primary Examiner*—Brenda A Lamb
(74) *Attorney, Agent, or Firm*—Taylor & Aust, P.C.

(57) ABSTRACT

A machine for single or double sided application of a liquid or viscous coating medium by way of at least one applicator unit onto the surface of a mating material web, especially a paper or cardboard web. A medium collecting device that is allocated to the applicator unit or to a dispensing component of the applicator unit which includes the dispensing openings, is equipped with a receiving and release component which is allocated to the medium collecting device and which is or can be mounted detachably on same. During the start of the application process the component releases the curtain or veil due to a common adjustment with the medium collecting device or of a section component of same relative to the curtain or veil from a rim extending across the moving background or from an edge extending across the moving background.

14 Claims, 7 Drawing Sheets

U.S. PATENT DOCUMENTS

| | | | | |
|---|---|---|---|---|
| 5,773,093 | A | 6/1998 | Mitani et al. | 427/420 |
| 5,885,659 | A | 3/1999 | Takahashi et al. | 427/420 |
| 6,464,784 | B1 * | 10/2002 | Piccinino et al. | 118/203 |
| 6,468,592 | B1 * | 10/2002 | Becker et al. | 427/420 |
| 6,610,148 | B2 | 8/2003 | Ruschak et al. | 118/325 |
| 6,709,517 | B1 * | 3/2004 | Holtmann et al. | 118/326 |
| 6,729,236 | B2 * | 5/2004 | Knabe et al. | 101/423 |
| 2003/0039761 | A1 | 2/2003 | Shiraishi et al. | 427/420 |

FOREIGN PATENT DOCUMENTS

| | | | |
|---|---|---|---|
| DE | 198 23 686 | | 1/1999 |
| DE | 199 03 559 | | 10/1999 |
| JP | 10-323604 | * | 12/1998 |
| JP | 112 00 299 | | 7/1999 |

OTHER PUBLICATIONS

Office Action dated Nov. 6, 2008 in U.S. Appl. No. 11/931,262.
Office Action dated Mar. 5, 2009 in U.S. Appl. No. 11/931,262.
Advisory Action dated May 15, 2009 in U.S. Appl. No. 11/931,262.

* cited by examiner

MACHINE FOR SINGLE SIDED OR DOUBLE SIDED APPLICATION OF A LIQUID OR VISCOUS COATING MEDIUM ONTO THE SURFACE OF A MOVING MATERIAL WEB, AND ASSOCIATED OPERATING METHOD

BACKGROUND OF THE INVENTION

1. Field of the Invention

The present invention relates to a machine for single sided or double sided application of a liquid or viscous coating medium by way of at least one applicator device onto the surface of a moving material web, especially a paper or cardboard web.

2. Description of the Related Art

With a view to guaranteeing good coating results that meet high quality standards, the various components of the referenced machinery, as well as the coating medium collecting device are subject to a multitude of requirements. Considering that the curtain or veil should not be too high, in other words, that the dispensing opening arrangement is not too high above the moving background, the medium collecting device should be constructed comparatively compactly, especially with regard to its height. On the other hand, a methodical removal of the collected medium through the collecting device must be ensured. This can be difficult, especially with highly viscous mediums and/or very wide machines and under conventional projections may only be possible with the acceptance of a high curtain height.

The addressed requirements are obviously competing with each other. The problem can be alleviated somewhat by making the coating application onto a material web segment that inclines or drops off in the direction of web travel and in that the coating medium is removed at least initially, in the direction of web travel, or in the direction opposite to web travel. In spite of this, the problem of accepting and releasing the curtain or veil through the medium collecting device as closely as possible above the moving background, especially the material web surface, remains in order to avoid or at least reduce contraction of the released or severed curtain, so that the background is not treated with undefined coating medium, especially coating medium drops. What is needed in the art is an improvement in this area.

In a narrower context of the previously cited problem an additional requirement arises in that, to pick up the curtain or veil in order to interrupt the application process, or to release it to start the application process through elements of a suitably formed edge so that an undefined treatment of the moving background, especially the moving material web with coating medium is avoided. With conventional coating medium collection devices that are in the embodiment of pans or troughs (so-called "starter troughs") that extend across the material web, a situation may arise where the curtain may run off a wall of the starter trough due to adhesion and surface tension effects in the manner of the well known "tea pot effect" and drip from the wall in an undefined fashion onto the background. This type of coating medium run-off from surface segments of the medium collecting device should be avoided. What is needed in the art is an improvement in this area.

With machinery of the referenced type, clean-up of components and surfaces which are in contact with the coating medium is generally an issue. This also applies especially to the coating medium collecting device. Since this type of machinery is often subject to space restrictions in direction of web travel, as well as to height restrictions this denotes that only limited space is usually available for the provided "curtain nozzle" and the medium collecting device allocated to the nozzle. This frequently results in difficult access to the medium collecting device for clean-up purposes. In addition it is desirable if a quasi-automatic clean-up process without the direct intervention of the operating personnel upon the components that are to be cleaned is possible. What is needed in the art is to render possible an effective clean-up method for the medium collecting device.

SUMMARY OF THE INVENTION

The present invention relates to a machine for single sided or double sided application of a liquid or viscous coating medium by way of at least one applicator device onto the surface of a moving material web, especially a paper or cardboard web, whereby the applicator device delivers the coating medium through an arrangement of dispensing openings, especially a slotted nozzle either directly or via at least one guide surface, in the form of a curtain or veil which under the influence of gravitation or other forces moves toward a moving background. In the instance of direct application the moving background is the surface of the material web and in the instance of the indirect application the moving background is the surface of a transfer element, preferably a transfer roll which then transfers the coating medium to the surface of the material web. The machine includes a coating medium collecting device, possibly a catch pan or catch trough that is allocated to the applicator unit or to a dispensing section of the applicator unit which includes the dispensing opening arrangement. The collection device is intended to collect coating medium that is dispensed from the dispensing opening arrangement during startup and/or completion of the application process and/or during interruption of the operational phase.

The present invention provides, with regard to the machinery referenced at the beginning, that the medium collecting device be equipped with at least one receiving and release component which is allocated to it and which is or can be mounted detachably on the medium collecting device. During the start of the application process, the component releases the curtain or veil due to a common adjustment with the medium collecting device or of a section component of the same relative to the curtain or veil from a rim extending across the moving background or from an edge extending across the moving background; and/or the receiving and release component does, based on a common adjustment with the medium collecting device or a section component of same relative to the curtain or veil, at least initially engage with and pick up and hold the curtain or veil away from the moving background with the rim or edge extending across the moving background, during an interruption or at the completion of the coating process.

The method according to the present invention simply resolves two essentially competing conditions at the same time. It achieves on the one hand that the curtain is released as low as possible above the moving background for the start of the coating process, and is picked up during an interruption or at completion of the coating process. Local excessive application due to the curtain contracting because of surface tension can therefore be avoided, or at least reduced. On the other hand and in spite of this a large coating medium flow can still be captured, held and discharged based on appropriate construction of the medium collecting device or its section components, for example if a sufficiently high limiting wall is provided for the receiving and release component. It is entirely feasible that in the course of the interaction with the curtain, applied coating medium simply remains on the receiving and release component whose rim or edge may be located much lower above the moving background, especially the material web, than an upper rim of the limiting wall, and is not removed to the medium collecting device or its section component, or toward the web edge.

In accordance with the first aspect, the present invention in addition provides a method for operation of the machinery in accordance with the present invention. It is suggested that prior to the start of the coating application the receiving and release component or at least one receiving and release component of several allocated receiving and release components is mounted on the medium collecting device and/or that prior to the start of the coating application process or after the start of the coating application process during continuous coating operation, prior to completion or during interruption of the coating process the receiving and release component that contains coating medium or to which coating medium adheres is removed from the medium collecting device and that the, or at least one other, especially cleaned receiving and release component that is free from coating medium is again mounted to the medium collecting device. This method permits easy removal of residual coating medium from the receiving and release component.

The present invention provides with regard to the machinery referenced at the beginning or, in an advancement, with regard to the inventive machinery in accordance with the present invention that the medium collecting device or the receiving and release component assigned to the collecting device exhibits a tabular, especially knife-edge type edge that extends across the moving background. The edge progresses preferably ascending to a sharp edge extending in direction of travel of the background or in opposite direction to the direction of travel across the moving background. Through elements of an adjustment relative to the curtain or veil it serves to release the curtain or veil at the start of the coating application process to permit it to move toward the moving background, and/or it engages with the curtain or veil during interruption or at completion of the application process, through elements of an adjustment relative to the curtain or veil. This configuration of the edge extending across the moving background avoids that, during an interruption of the application process the curtains makes contact with a surface on which drops can form and run off, or that during release of the curtain it can run off a surface because to drops that formed under the so-called "tea pot effect". An ideal embodiment of the edge is a knife-type sharp edge.

It has proven especially advantageous if the edge extends at an angle of 20° to 60°, preferably at an angle of 30° to 50° from a horizontal line, either in direction of web travel or in opposite direction. It has also proven advantageous if the edge extends over 5 to 50 mm, preferably over 10 to 30 mm in horizontal direction.

It is advantageous if the edge originates from an essentially vertically progressing wall section of the medium collecting device or a sectional component of same, or from the receiving and release component. In this context it has proven useful if the wall section extends in vertical direction over 0 to 50 mm, preferably over 0 to 30 mm, and most preferably over 10 to 20 mm.

The wall section or the edge can advantageously originate from a horizontally or inclined progressing floor section of the medium collecting device or a sectional component of same, or from the receiving and release component. In this context it has proven useful if the floor section slopes at an angle of 0° to 50°, preferably at an angle of 0° to 30°, and most preferably at an angle of 5° to 15° from horizontal.

The present invention provides that at least one supply line is allocated to the medium collecting device that is connected or can be connected to a cleaning liquid supply and through which the surface sections of the medium collecting device that come in contact with the collected coating medium can be supplied with cleaning liquid. The supply line may be an integral part of the medium collecting device. The supply line extends for example transversely to the direction of travel of the material web across the entire cross dimension of the medium collecting unit. Particularly advantageous is an embodiment of the supply line in the form of a spray pipe.

The present invention provides surprising results in that since it is known that, generally, recovery and, ordinarily after processing, reuse of the coating medium that was collected by the medium collecting unit is provided for. Such a recovery is made difficult, or impossible, if cleaning liquid, perhaps water, is admitted into the coating medium return.

In order to make recovery possible in spite of this, or to at least make it easier, a further advancement of the present invention is suggested that provides for a valve arrangement which is connected to the medium collecting unit via at least a first connection and is connected to a cleaning liquid supply or cleaning liquid disposal or cleaning liquid processing or recovery via at least a second connection, and that is connected via at least a third connection to a coating medium processing or recovery arrangement, whereby the valve arrangement is reversible between a first valve condition where the first connection is connected with the second connection, and a second valve condition where the first connection is connected with the third connection. In this arrangement collected coating medium and used cleaning liquid can be routed separately and supplied to respective additional use or disposal.

In accordance with another aspect the present invention further provides a method for the operation of the inventive machine. It is generally provided that the coating medium collecting unit is cleaned prior to, during or after an application process of the machine, by way of supplying cleaning liquid via the supply line. With reference to the further expanded machine according to the third aspect it is specifically suggested for the method that the valve arrangement is switched to the second valve condition for clean-up and that the valve arrangement is switched to the third valve condition for the collection of coating medium in the medium collecting device. An especially preferred design arrangement of the method emphasizes that the medium collecting unit is cleaned after start of the application process, during coating, through elements of supplying cleaning liquid via the supply line.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
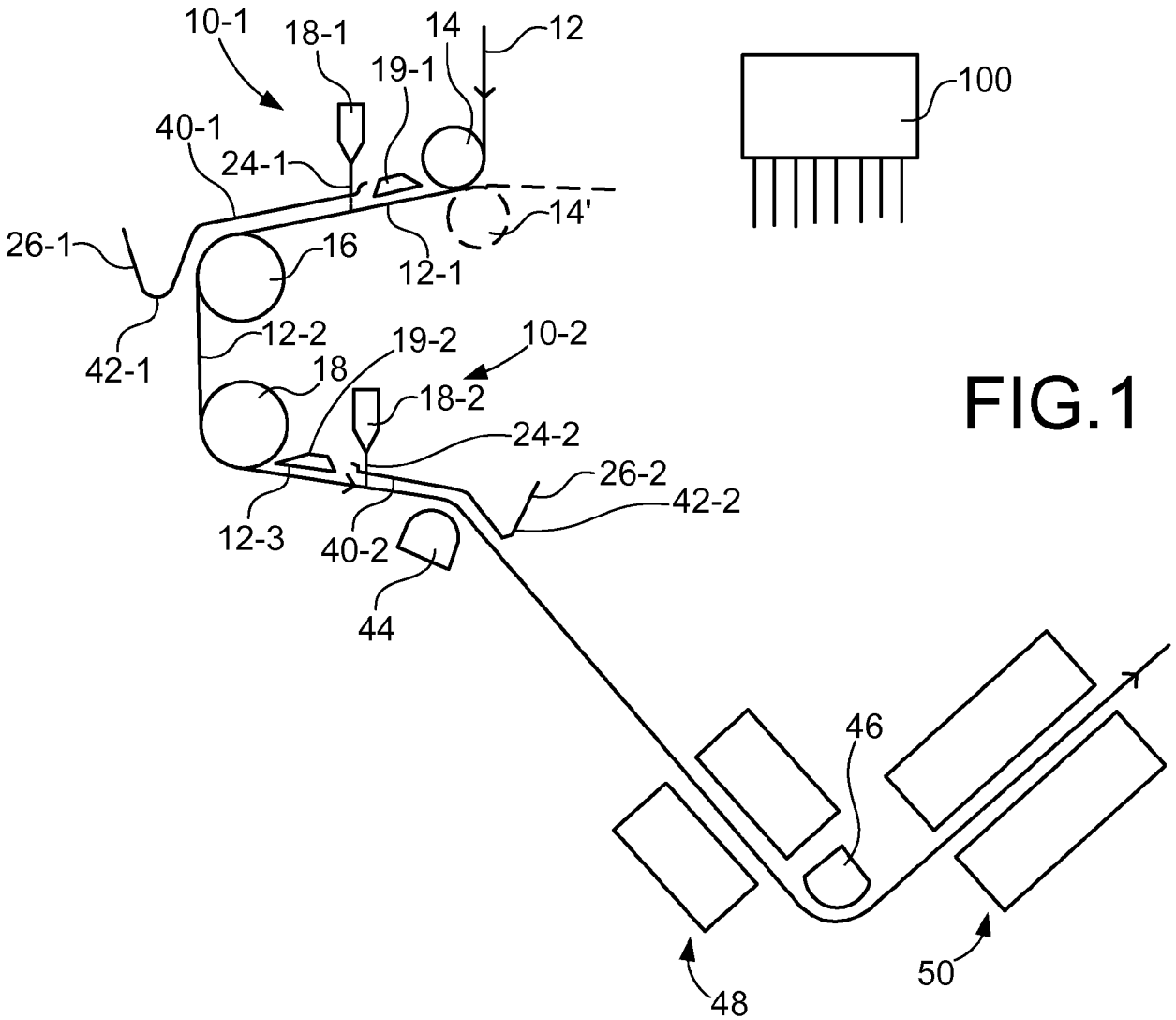
FIG. 1 is a schematic view of an embodiment of an inventive coating machine for two-sided application onto a paper or cardboard web according to the present invention.

Referring now to the drawings, and more particularly to FIG. 1, there is shown a schematic depiction of two curtain-type applicators 10-1 and 10-2 in a coating machine for direct curtain coating application onto both sides of a paper or cardboard web 12. The material web, which can be a fiber web, that runs over a turning roller arrangement includes turning rollers 14, 14', 16 and 18 runs according to FIG. 1 for example from the top to turning roller 14 or, alternatively from the right to turning rollers 14' (broken line), first passes underneath a curtain application head 18-1 of the first curtain applicator 10-1 so that the first surface of the material web is coated. The curtain applicator head includes the usual distributor chamber in cross direction to the direction of travel of the material web, and a slotted nozzle progressing in the same direction, which applies the curtain or veil of coating medium, especially coating ink. The curtain or veil 24-1 impacts on a segment 12-1 of material web 12 which slopes from the horizontal, in direction of travel and which is supported by turning rollers 14 or 16, or 14' and 16.

Figure 2:
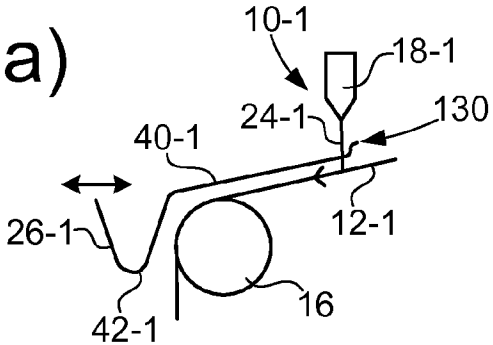
FIGS. 2*a*-2*b* are schematic views which illustrates in partial FIGS. 2*a*) and 2*b*) a possibility for collecting the coating medium by way of an adjustable medium collecting unit, relative to starting, interruption or completion of the curtain application according to the present invention.
Figure 2:
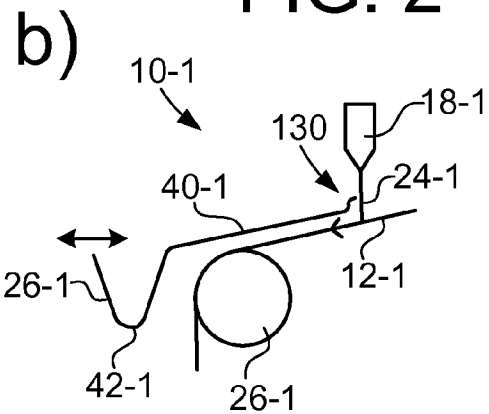

During start-up of the coater or in the event of short operational interruptions, for example in the event of a web break, as well as during completion of the application process the coating medium curtain or veil is captured by a movable medium collecting device 26-1. This device is illustrated in FIG. 1 in a pick-up position, capturing curtain 24-1. The curtain is depicted in a broken line, but is shown extended to the point of material cut-off 12-1, in order to illustrate the application position. FIGS. 2*a*-2*b* illustrate the range of curtain applicator 10-1 for both positions of medium collecting device 26-1. FIG. 2*a* shows medium collecting device 26-1 in the collecting position according to FIG. 1 and FIG. 2*b* shows medium collecting device 26-1 in an application position where, in contrast to the collecting position it is offset in the direction of web travel, so that curtain 24-1 impacts the slanted material section 12-1.

Medium collecting device 26-1 includes a catch plate 40-1 which extends across the entire curtain width in cross direction to the direction of web travel and which extends essentially parallel to slanted material section 12-1. It therefore also slopes from the horizontal; it further includes a receiving and discharge trough 42-1 that extends in cross direction to the direction of web travel and slopes in that direction in order to cross-directionally discharge the coating medium supplied to it by the catch plate. The captured coating medium is discharged on catch plate 40-1, first in direction of web travel and subsequently in trough 42-1 in cross direction to the direction of web travel. The receiving and discharge trough 42-1 is located next to a vertically progressing material web section 12-2, or in other words next to the web guide section including turning rollers 16 and 18, supporting the web section, essentially at the same height as turning roller 16, so that sufficient space is available in height direction. Therefore, large volumes of coating medium can be picked up and discharged, as may be necessary with very large web widths. In addition, a comparatively large discharge gradient in cross direction to the direction of web travel can be provided, as would be required, for example, for highly viscous coating mediums, especially coating inks. For reference purposes it can be stated that typical coating inks for curtain-type application have a viscosity of 50 to 500 mPS (=cP, Centipoise). In contrast, highly viscous coating inks have a viscosity of higher than 500 mPs (=cP, Centipoise), again for reference purposes. The construction of the medium collecting device according to medium collecting device 26-1 is especially suitable for highly viscous coating inks, or medium collecting device 26-1 can be designed to be optimally suitable for highly viscous coating inks with regard to holding capacity of the receiving and discharge trough 42-1, with regard to the gradient of this trough in cross direction to the direction of web travel, as well as with regard to the gradient of catch plate 40-1 in direction of web travel.

Due to the web routing through the turn roller assembly, including turn rollers 16, 18, the other (second) side of the material web is now accessible for medium application, as described above. The second curtain applicator unit 10-2 accordingly includes a curtain applicator head 18-2 that dispenses a curtain 24-2 onto a further material section designated 12-3, which, again is sloped from the horizontal in the direction of web travel. A medium collection device 26-2 is again provided which is adjustable between one collection position in which curtain 24-2 impacts a catch plate 40-2 and is discharged via the catch plate and a catch and discharge trough 42-2 and one application position where the curtain impacts the material web section 12-3. The explanations and details given for collecting device 26-1 with reference to FIG. 2 apply accordingly for medium collecting device 26-2.

Since no intermediate drying is provided between the curtain coaters, only the web turning roll assembly which makes contact with the second web surface that has not been coated by the first curtain applicator unit 18-1, material web section 12-3 is held under contact prior to applicator head 18-2 by turn roller 18 and contact free by an air-turn 44 after curtain applicator head 18-2. The air-turn is part of the web guide arrangement and interacts with an additional air-turn 46, in order to carry the web first through a contact-free dryer 48 and then through a contact-free dryer 50. Drying devices 48 and 50 may, for example be infrared dryers or hot air dryers.

Prior to applicator head 18-1 or 18-2 a device 19-1 or 19-2 may advantageously be provided for the removal or weakening of an air boundary layer that is carried along with the material web. This device may for example be in the form of a boundary layer suction device or boundary layer doctor blade.

Figure 3:
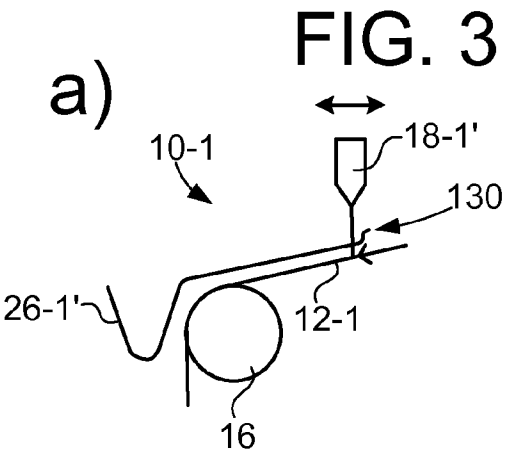
FIGS. 3*a*-3*b* are schematic views which shows an additional variation for the collection of the coating medium through elements of an adjustable medium collecting unit, relative to starting, interruption or completion of the curtain application according to the present invention.
Figure 3:
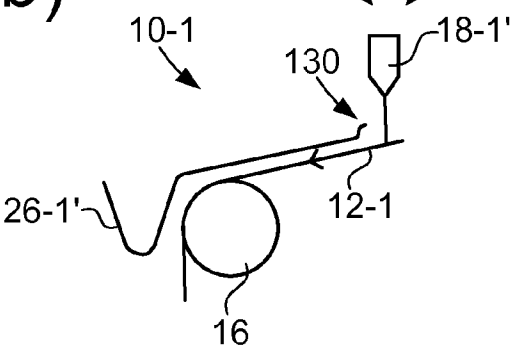

It must be pointed out that it is not imperative that medium collecting device 40-1 or 40-2 is adjustable and applicator head 18-1 or 18-2 is stationary. FIGS. 3*a*-3*b* depict a deviation of the coater where the respective applicator head, in FIGS. 3*a*-3*b* particularly the first applicator head 18-1', is adjustable between a pick-up position where the dispensed curtain impacts the catch plate of stationary medium collection device 26-1' (FIG. 3*a*), and an application position where the curtain impacts the material web section 12-1 that slopes in direction of web travel (FIG. 3*b*). Corresponding devices can be provided for the curtain applicator head and the medium collecting device of second applicator unit 10-2.

It must also be pointed out that the depictions in FIGS. 1-3*b* do not represent the optimum solution with regard to the layout of the catch plate of the medium collecting device. The catch plate of the medium collecting device, or at least its edge that progresses transversely to the direction of web travel which, at the completion of the curtain application in a matter of speaking severs the curtain, based on an adjustment of the applicator head and/or the medium collecting device and which, at the beginning of the application process in a matter of speaking releases the curtain, based on correspondingly opposite adjustment of the applicator head and/or the medium collecting device should, in deviation from the schematic depiction in FIGS. 1-3*b* be positioned as low as possible above the material web section that is to be coated.

Figure 4:
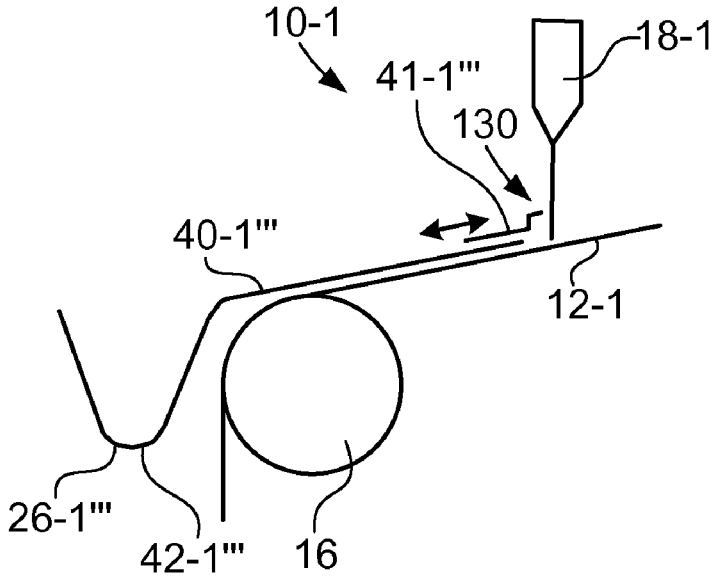
FIGS. 4-7 are schematic views which show additional advantageous design variations of the coater illustrated in FIG. 1, relating to the medium collecting unit and its function during start, interruption and completion of the curtain application and represent additional design variations of inventive coaters.

Instead of adjusting the entire medium collection device, an adjustment could advantageously be made of only one receiving plate 41-1''' of the medium collecting device, as depicted in FIG. 4. From receiving plate 41-1''', which functionally can also be described on its own as a medium collecting device (when designating component 26-1''' as a "collecting pan" or similar device) the collected coating medium runs onto catch plate 40-1''' and from this into catch and discharge trough 42-1'''. Receiving plate 41-1''' can be equipped with a specially designed cut-off edge for severing or releasing of the curtain, in order to minimize accumulations of coating medium following pulling together of the curtain due to surface tension.

Figure 5:
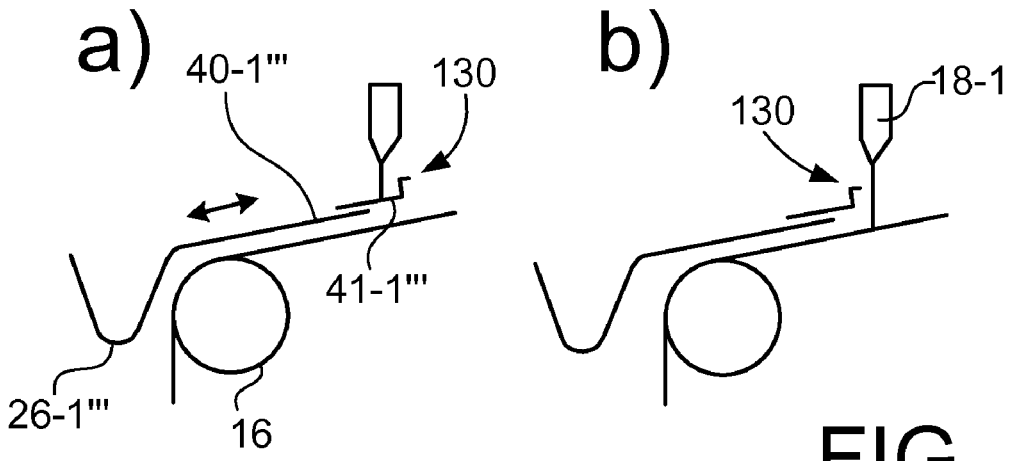

Other embodiments of the medium collecting device are also feasible. FIGS. 5*a*-5*b* illustrate in its sectional views 5*a*) and 5*b*) a variation of the arrangement according to FIG. 4. Here, receiving plate 41-1 is located firmly on catch place plate 40-1 and is adjustable together with medium collecting device 26-1 between a collecting position and an application position, relative to stationary applicator head 18-1. Receiving plate 41-1 can be mounted detachably on medium collecting device 26-1 and can be removable, possibly for clean-up purposes or for replacement, if required, with a clean receiving plate. Receiving plate 41-1 may also be considered part of the medium collecting device.

Figure 6:
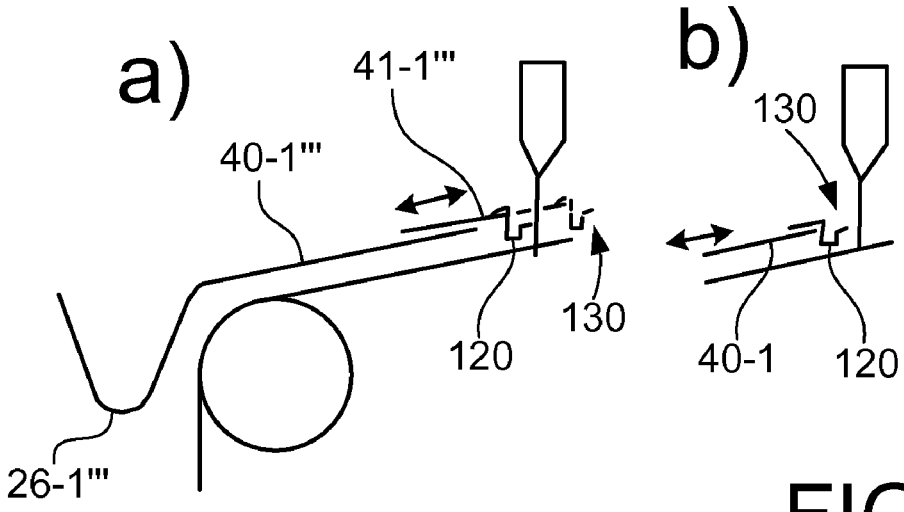

FIGS. 6*a*-6*b* shows in detail 6*a* the possibility that receiving plate 40-1''' that is adjustable relative to medium collecting device 26-1''' does not release or sever the curtain by itself, but that it is equipped with a separate receiving and release component 120 which is or will be mounted detachably on the receiving plate. The receiving and release component 120 which may be viewed as part of the medium collecting device is suspended, for example on a free edge of the receiving plate. The receiving and release component is optimized with regard to releasing the curtain at the start of the application, or with regard to severing the curtain at completion or during interruption of the application process, so that an undefined application of coating medium onto the material web is avoided or at least held to a minimum. It can be ensured that the edge that severs or releases the curtain is located as low as possible above the material web surface and that the curtain does not run off, or moisten surface sections of the medium collecting device while being severed or released, thereby risking an undefined application of coating medium onto the material web surface, for example due to dripping coating medium. The design of the receiving and release component is such that the coating medium separates itself flawlessly from an edge of the receiving and release component upon release, without running off the surface of the receiving and release component, due to surface tension and adhesion effects ("tea pot effect") and that the curtain when it is severed, does not impact tabular surface sections of the receiving and release component.

In order to achieve this function one can accept that the receiving and release component accepts coating medium that cannot be discharged by the receiving and release component, but will remain on the receiving and release component until a change-out or clean-up. As indicated with a broken line in FIG. 6*a*, the receiving and release component in the collecting position, occupies a position beyond the curtain. In the collecting position, the curtain therefore falls onto the receiving plate 41-1''' and runs over the receiving plate onto catch plate 40-1 of medium collecting device 26-1'''. When adjusting receiving plate 41-1" between the application position in which the curtain drops onto the material web surface and the pick-up position, in which the curtain falls onto the receiving plate, the coating medium falls only momentarily onto the receiving or release component 120, and the amount of coating medium received by the component may remain on the receiving and release component 120. Referred to the application cycle (start of the curtain application through completion of the curtain application) it is preferable to remove coating medium from the receiving and release component at the end of the cycle, that is after resetting of receiving plate 41-1''' into the collecting position. This is done by removing the receiving and release component from the receiving plate and cleaning it, or by replacing it with another receiving and release component that is free of coating medium.

Such a receiving and release component can also be located directly on catch plate 40-1 of the adjustable medium collecting device 26-1 (FIGS. 6*a*-6*b*) or the stationary medium collecting device, in order to fulfill the same functions there, as indicated in the example in FIG. 6*a*.

Figure 7:
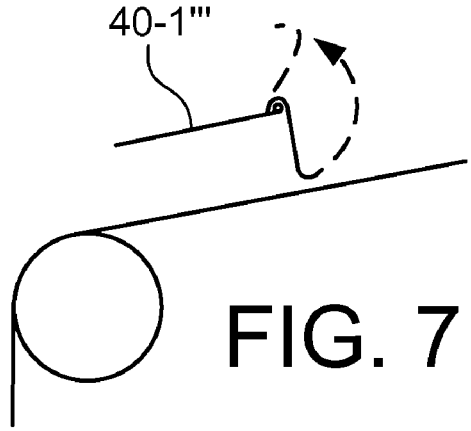

FIG. 7 shows schematics of additional design variations of the medium collecting device. It shows a cross section of an already known spoon-type receiving and releasing component that is pivoted relative to the catch plate 40-1, in order to be able to receive and release the curtain very low above the material web surface on the one hand, and to let collected coating medium run off to catch plate 40-1, on the other hand. This receiving and release component may also be designed to be replaceable.

Figure 8:
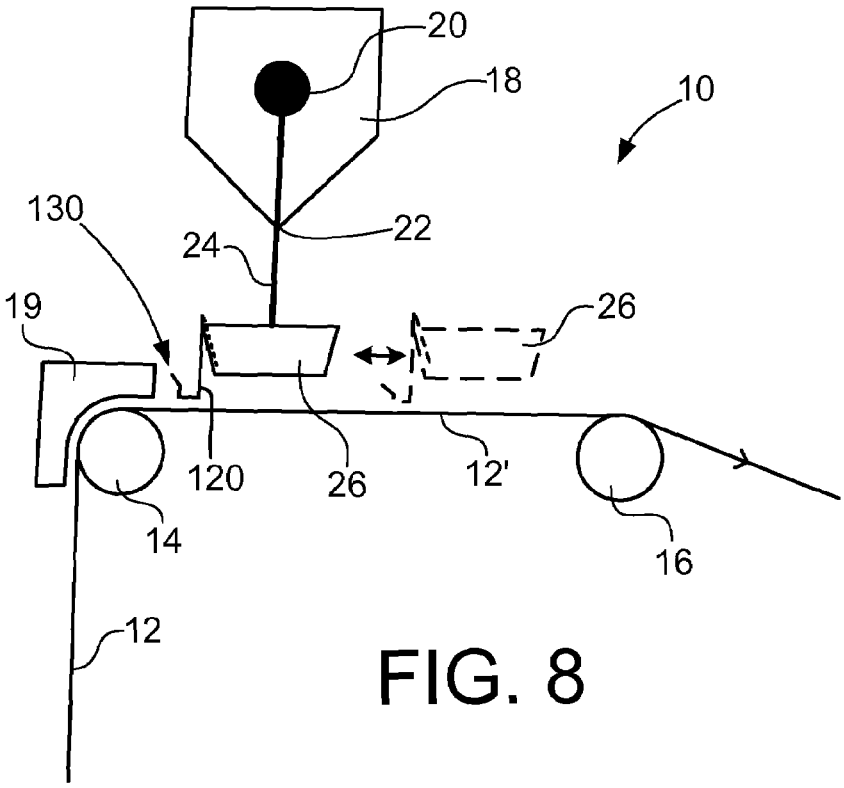
FIG. 8 is a schematic view which illustrates an additional example of an inventive coater according to the present invention.
Figure 9:
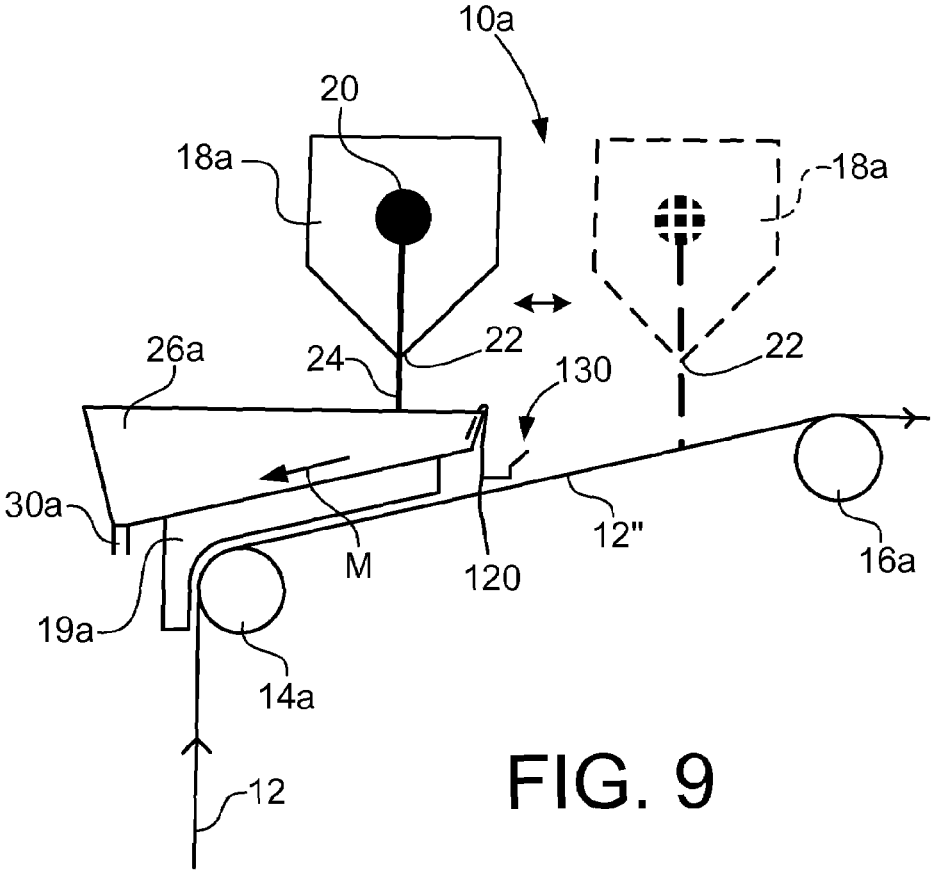
FIG. 9 is a schematic view which illustrates an additional example of an inventive coater according to the present invention.

Again referring to the design variations in FIGS. 6*a*-6*b* it must be pointed out, that the receiving and release component illustrated therein that is detachably mounted and is replaceable is especially advantageous if the medium collecting device is equipped with limiting walls that rise high above the material web surface, as is illustrated in FIG. 8 and FIG. 9.

FIG. 8 is a schematic of a curtain applicator 10 in a coating machine, for direct curtain coating application onto a paper or cardboard material web 12. Material web 12 which is routed through a guide assembly including turn rollers 14 and 16 passes below a curtain applicator head 18. The curtain applicator head includes the distributor chamber 20 in cross direction to the direction of travel of the material web, and a slotted nozzle 22 progressing in the same direction which applies curtain or veil 24 of coating medium, especially coating ink. Curtain or veil 24 impacts on a horizontally progressing segment 12' of material web 12.

During start-up of the coater, or in the event of a momentary interruption of operation, for example in the event of a web break, the coating medium curtain or veil is captured by a movable catch trough 26 which is illustrated in FIG. 8 in a solid line in a collecting position whereby it picks up the curtain. It is however optionally machine-adjustable into an application position where it does not capture curtain 24, so that the horizontally progressing material web section 12' is coated in the usual manner. FIG. 8 also shows catch trough 26 in broken lines it its application position.

A so-called Aircut, air boundary layer doctor blade or an air boundary layer suction device that is identified with 19 and acts upon material web 12 in the area of turn roller 14 may be installed upstream from the applicator unit.

In the embodiment according to FIG. 9 medium collecting device 26*a* is stationary and is integrated with coating pretreatment device 28*a* into one component. In order to be able to capture coating medium curtain 24 during start-up of the coating machine, or during momentary operational interruptions, curtain applicator head 18*a* is machine-adjustable between a pick-up position that is illustrated in FIG. 9 by a solid line where the curtain is captured by medium collecting device 26*a*, and an application position that is illustrated in FIG. 9 by a broken line where applicator head 18*a* applies coating onto a material web section 12' that inclines in direction of travel of web 12. The coating medium that is collected by the medium collecting device, different to that shown in the example in FIG. 8, is initially not discharged in cross direction to the direction of material web travel, but instead in opposite direction to its direction of travel, in the direction of the arrow M, toward a symbolically illustrated medium discharge 30*a*, or several appropriate medium discharges.

If the receiving and release component 120 is not suspended on the medium collecting device 26 or 26*a*, then the coating medium runs off on the outside wall of the medium collecting device and drip uncontrolled unto the material surface in the course of coating start-up and when severing the curtain for the purpose of ending the curtain coating application. This is prevented by the special design form of the receiving and release component where, in the application position, a release and severing edge protrudes at an angle in the direction of the curtain. In addition, this severing and release edge is positioned clearly lower above the material web surface than the upper edge of the medium collecting device, so that in addition a contracting of the released curtain due to surface tension, dripping, etc is avoided, or at least brought to a minimum.

The coaters in the above cited examples each include a control unit (control unit 100 in FIG. 1) through which the coating process is controlled, especially at the beginning of the coating process, or during interruptions or completion of the coating process. Controller 100 controls especially an actuator arrangement that adjusts the respective applicator head 18-1 or 18-2 or 18*a* and/or the respective allocated medium collecting device or its receiving plate in order to release the curtain for deposit onto the surface of the material web at the start of the procedure, or to capture the curtain at the end of the coating application procedure by way of the collecting device.

It is preferred that, at the beginning of the application process a stable curtain is adjusted initially while the curtain drops onto the collecting device. Once a stable curtain is achieved and the coater is generally operating in its desired state (desired running speed of material web, operating temperature of dryers), then the control unit adjusts the medium collecting device, or its receiving plate and/or the applicator head, so that the curtain subsequently drops onto the material web surface.

The control unit accordingly interrupts or ends the application process through adjustment of the medium collecting device or its receiving plate, and of the respective applicator head relative to each other, so that the curtain is again captured by the collecting device.

Figure 10:
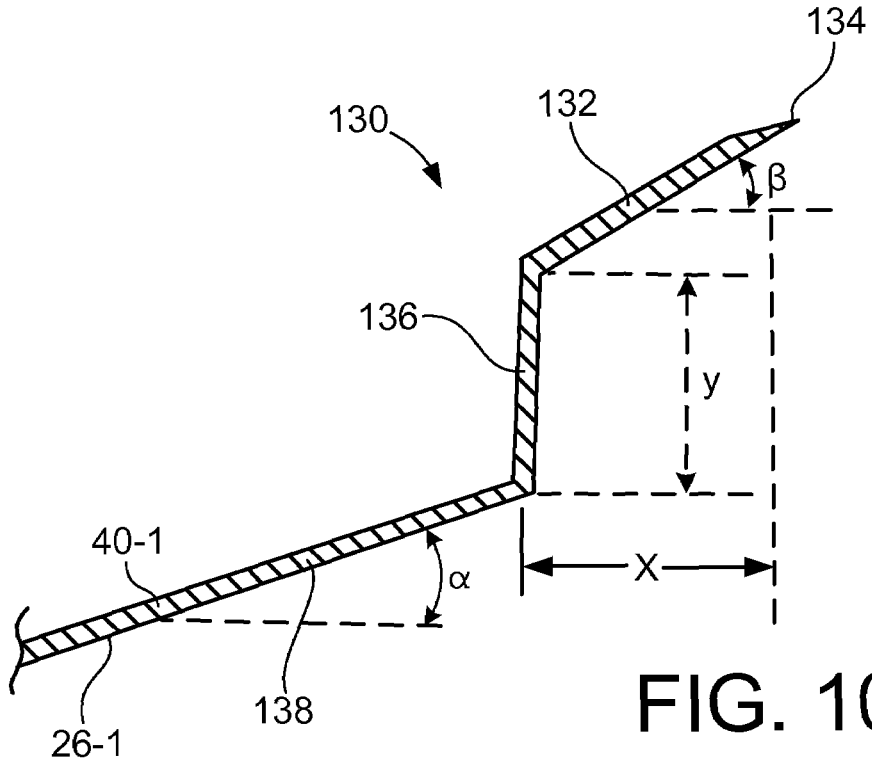
FIG. 10 is a schematic view which illustrates a curtain cut-off and release edge of the medium collecting unit, catch plate or receiving and release component that is realized in accordance with the present invention in the embodiment examples shown in FIGS. 1-6*b*, 8 and 9, whereby FIG. 10 refers tangibly to the design of the collecting plate of the medium collecting unit in the examples FIG. 1 through 3*b;*
Figure 11:
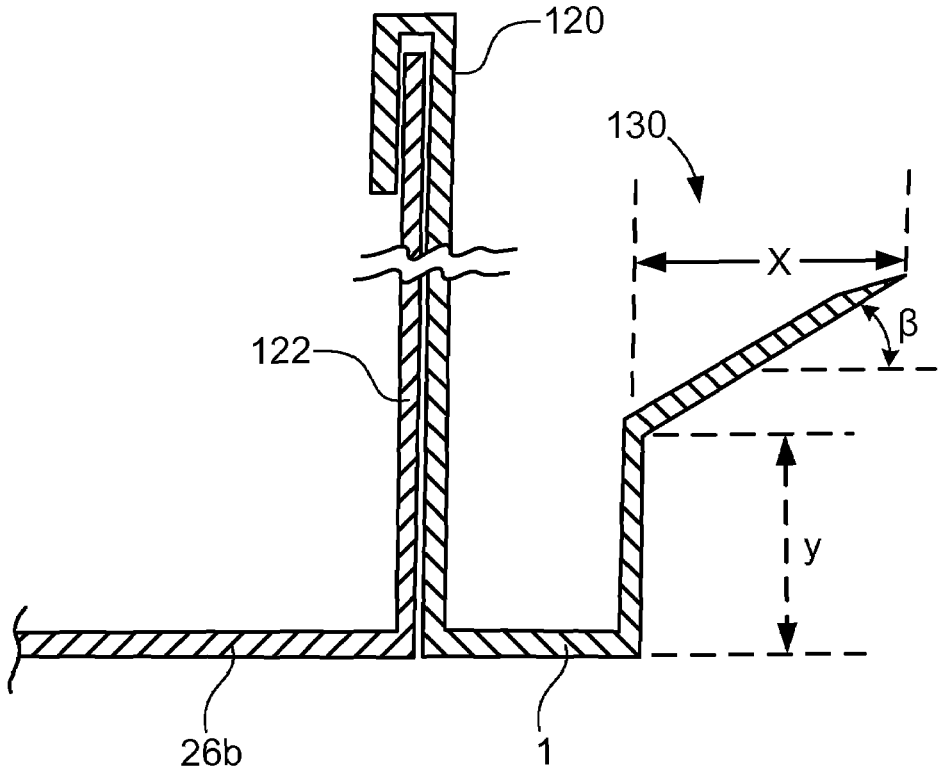
FIG. 11 is a schematic view which illustrates an inventive receiving and release component that is suspended on a trough or channel type medium collecting unit and is provided with a curtain cut-off and release edge, according to FIG. 10.

The catch plates of the medium collecting device according to the examples in FIGS. 1-3*b*, the receiving plate which is adjustable relative to the catch plate according to the example in FIG. 4, the receiving plate which is located detachably on the catch plate according to the example in FIGS. 5*a*-5*b* and the receiving and release components on the receiving plate according to the examples in FIG. 6*a*-6*b* or the catch trough according to the design example in FIGS. 8 and 9 are, as indicated in the drawings, equipped with a specially designed curtain severing and release edge 130. A particularly advantageous embodiment of the curtain severing and release edge can be recognized more clearly in FIGS. 10 and 11. FIG. 10 especially shows the configuration of the catch plate 40-1 of a medium collecting device according to FIGS. 1 and 2 which provides for a single-component curtain severing and release edge, while FIG. 11 illustrates especially the example of a receiving and release component 120, that includes the single-component curtain severing and release edge 130 that is provided on it. The receiving and release component is suspended on a medium collecting device 26*b* which is in the embodiment of a catch-pan or catch-trough with vertical erect walls 122.

The curtain severing and release edge includes at least one cutting edge section 132 that, in the application position, progresses in the direction toward the curtain at an incline and terminates preferably in a sharp cutting edge 134. An even, tabular configuration of cutting edge 132 is preferred whereby this progresses preferably at an angle $\beta$ of 30° to 50° from the horizontal in the direction of toward curtain (in the application position) or in the direction of travel, or opposite to the direction of travel.

Cutting edge 132 originates preferably from an essentially vertical wall section 136 of curtain severing and release edge 130, which extends preferably vertically over a height of 0 to 30 mm, and most preferably over a height of 10 to 20 mm (dimension y). Originating from wall section 136, or alternatively immediately from main section 138 of catch plate 40-1, cutting edge 132 extends preferably over 10 to 30 mm in horizontal direction (dimension x).

Main section 138 of catch plate 40-1 is preferably level and can extend advantageously at an angle $\alpha$ of 0° to 30°, preferably at an angle $\alpha$ of 5° to 15° from the horizontal, possibly parallel to the possibly inclining or sloping material web.

The gradient of cutting edge 132 and the distance between cutting edge 134 and wall section 136 in horizontal direction is such that the severed or released curtain does not run off or come in contact with the underside of cutting edge 132 or the outside surface of wall section 136. The curtain is severed at the completion of the application process and is released cleanly at the start of the application process without coating medium drops forming on the curtain cut-off and release edge, that could drop onto the material web. Drop formation resulting from a contraction of the released or severed curtain is thereby avoided, or at least reduced, so that cutting edge 134 can be positioned comparatively low above the material web surface, in any event lower than an upper edge of a pan-type medium collecting device that is designed for a large holding volume and discharge volume, as clearly indicated in FIG. 11.

Figure 12:
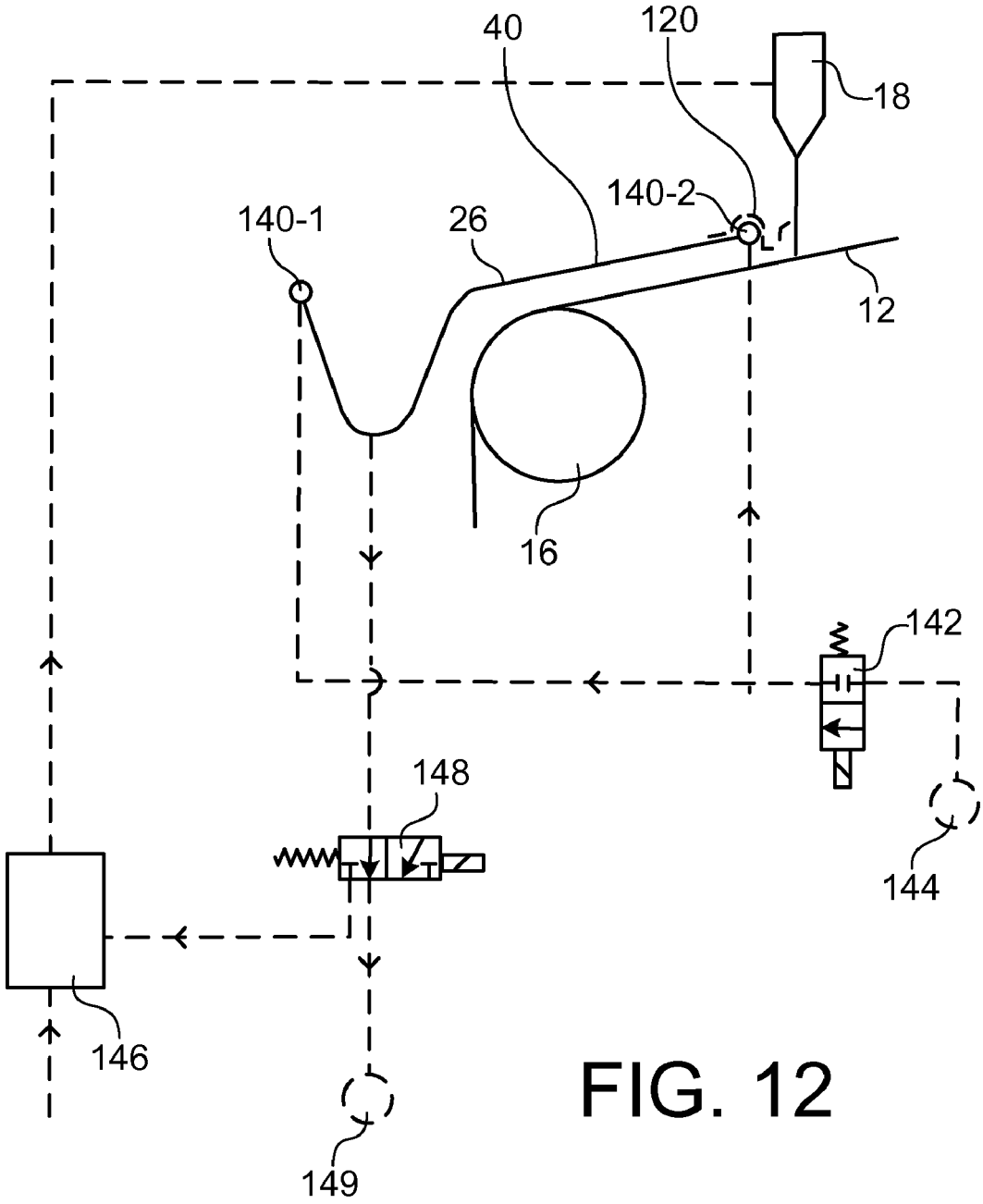
FIG. 12 is a schematic view which illustrates an advantageous further development of a respective medium collecting unit for cleaning purposes and represents an additional design example of an inventive coating machine according to the present invention.

In accordance with another aspect of the present invention, medium collecting device 26, or a respective medium collecting device 26 in a coating machine can be equipped with a clean-up arrangement for quasi-automatic clean-up of the medium collecting device. FIG. 12 illustrates such an arrangement. Medium collecting device 26 is equipped with two spray pipes 140-1 and 140-2, which extend transversely to the direction of web travel, across the entire width of medium collecting device 26, and is connected via a valve 142 to a cleaning liquid supply 144, for example a simple water line. A medium collecting device discharge, or discharges that are normally intended to discharge the collected coating medium (coating ink) to coating medium processing station 146 can, in the shown example, be connected via a changeover valve 148 to a cleaning liquid discharge line 149 or to coating medium processing station 146. This, on the one hand permits the normally useful coating medium-reprocessing and reutilization, and on the other hand enables the cleaning liquid that was used for clean-up of the medium collecting device to be discharged separately, for example to be disposed of or to be re-routed for reprocessing. Due to a relative adjustment between applicator head 18 and medium collecting device 26, the clean-up of medium collecting device 26 with the cleaning liquid can be carried out advantageously during the coating application, that is after the start of the application process. The broken line in FIG. 12 illustrates the feasibility that a possibly provided receiving and release component 120 can be suspended on the cleaning liquid supply line 140-2, which is located on the upper edge of catch-plate 40. The receiving and release component can be equipped with outlet recesses through which the cleaning liquid that is possibly emerging from the spray nozzles can pass. The receiving and release component may be advantageously equipped with the inventive curtain severing and release edge.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for one of a single sided application and double sided application of one of a liquid coating medium and a viscous coating medium by way of at least one applicator device of the machine onto a surface of a moving fiber web, whereby the at least one applicator device delivers one of the liquid coating medium and the viscous coating medium through an arrangement of dispensing openings one of directly and via at least one guide surface, in a form of a curtain which under an influence of one of a gravitation force and another force moves toward a moving background, and whereby in an instance of a direct application the moving background is a surface of the fiber web and in an instance of an indirect application the moving background is a surface of a transfer element which then transfers one of the liquid coating medium and the viscous coating medium to the surface of the material web, the machine comprising:

a coating medium collecting device that is allocated to one of the at least one applicator device which includes a dispensing opening arrangement and a dispensing component of the at least one applicator device which includes said dispensing opening arrangement, said coating medium collecting device collecting one of the liquid coating medium and the viscous coating medium that is dispensed from said dispensing opening arrangement during at least one of a startup of an application process, a completion of said application process, and during an interruption of an operational phase of said application process, said coating medium collecting device being equipped with at least one receiving and release component, said at least one receiving and release component including a first end portion and a second end portion, said second end portion including a vertical wall section from which originates only one curtain severing and release edge which is a tabular edge arranged at an angle from horizontal of approximately between 20 to 60°, said first end portion being hooked over and contacting opposing inner and outer surfaces of a vertical end wall of said coating medium collecting device so as to provide for detachably suspending said at least one receiving and release component over an upper free edge of said vertical end wall of said coating medium collecting device, said first end portion extending downwardly from said upper free edge and parallel to said vertical end wall of said coating medium collecting device so as to define with said vertical wall section of said second end portion a recess therebetween, selectively a) during said startup of said application process said at least one receiving and release component releasing the curtain due to a common adjustment with one of said coating medium collecting device and a section component of said coating medium collecting device relative to the curtain from said severing and release edge extending across the moving background and b) said at least one receiving and release component, based on a common adjustment with one of said coating medium collecting device and said section component of said coating medium collecting device relative to the curtain, at least initially engaging with and picking up and holding away from the moving background the curtain with said severing and release edge during one of said interruption of said application process and said completion of said application process, said at least one receiving and release component exhibiting only one said severing and release edge, said severing and release edge being said tabular edge having a tabular section which progresses so as to ascend and thereby terminate in only one free sharp edge, said tabular edge extending across the moving background, said tabular edge progressing extending one of in a direction of travel of the moving background and in an opposite direction to said direction of travel of the moving background across the moving background, said sharp edge serving to release the curtain at the start of said application process to permit the curtain to move toward the moving background, the curtain being released from said sharp edge of said at least one receiving and release component such that the curtain falls directly from said sharp edge to the moving surface, said sharp edge engaging with and cutting the curtain during at least one of said interruption of said application process and at said completion of said application process.

2. The machine of claim 1, wherein said fiber web is one of a paper web and a cardboard web.

3. The machine of claim 1, wherein said arrangement of dispensing openings is a slotted nozzle.

4. The machine of claim 1, wherein said transfer element is a transfer roll.

5. The machine of claim 1, wherein said coating medium collecting device is one of a catch pan and a catch trough.

6. The machine of claim 1, wherein said tabular edge is a knife edge.

7. The machine of claim 1, wherein said angle preferably is approximately between 30° and 50°.

8. The machine of claim 1, wherein said tabular edge extends in a horizontal direction approximately between 5 mm and 50 mm.

9. The machine of claim 1, wherein said tabular edge extends in a horizontal direction approximately between 10 mm and 30 mm.

10. The machine of claim 1, further including at least one supply line being allocated to said coating medium collecting device, said at least one supply line being connected to a cleaning liquid supply, a plurality of surface sections of said coating medium collecting device coming into contact with a collected one of the liquid coating medium and the viscous coating medium being supplied with a cleaning liquid through said at least one supply line.

11. The machine of claim 10, further including a valve arrangement being connected to said coating medium collecting device via at least a first connection, said valve arrangement being connected to one of said cleaning liquid supply, a cleaning liquid disposal, a cleaning liquid processing and a cleaning liquid recovery via at least a second connection, said valve arrangement being connected via at least a third connection to one of a coating medium processing arrangement and a coating medium recovery arrangement, whereby said valve arrangement is reversible between a first valve condition where said first connection is connected with said second connection, and a second valve condition where said first connection is connected with said third connection.

12. The machine of claim 11, wherein said coating medium collecting device is cleaned one of prior to, during and after said application process of the machine, by way of supplying said cleaning liquid via said at least one supply line.

13. The machine of claim 12, wherein said valve arrangement is switched to said second valve condition for a clean-up and said valve arrangement is switched to a third valve condition for a collection of one of the liquid coating medium and the viscous coating medium in said coating medium collecting device.

14. The machine of claim 12, wherein said coating medium collecting device is cleaned at least one of after said startup of said application process and during said application process, through elements of said cleaning liquid supply via said at least one supply line.

* * * * *